US008556568B2

(12) United States Patent
Fischer

(10) Patent No.: US 8,556,568 B2
(45) Date of Patent: Oct. 15, 2013

(54) FUEL PUMP WITH DUAL OUTLET PUMP

(75) Inventor: John G. Fischer, Goodrich, MI (US)

(73) Assignee: Delphi Technologies, Inc., Troy, MI (US)

( * ) Notice: Subject to any disclaimer, the term of this patent is extended or adjusted under 35 U.S.C. 154(b) by 969 days.

(21) Appl. No.: 12/627,633

(22) Filed: Nov. 30, 2009

(65) Prior Publication Data

US 2011/0129326 A1 Jun. 2, 2011

(51) Int. Cl.
*F04D 29/44* (2006.01)

(52) U.S. Cl.
USPC ..... 415/1; 415/55.1

(58) Field of Classification Search
USPC ..... 415/1, 55.1, 55.2, 55.3, 55.4, 55.7, 207
See application file for complete search history.

(56) References Cited

U.S. PATENT DOCUMENTS

| | | | | |
|---|---|---|---|---|
| 4,734,008 | A | 3/1988 | Roth | |
| 5,013,222 | A | 5/1991 | Sokol et al. | |
| 5,129,796 | A | 7/1992 | Emmert et al. | |
| 5,209,630 | A | 5/1993 | Roth | |
| 5,273,394 | A | 12/1993 | Samuel | |
| 5,280,213 | A | 1/1994 | Day | |
| 5,393,203 | A | 2/1995 | Hantle | |
| 5,393,206 | A | 2/1995 | Roth et al. | |
| 5,449,269 | A * | 9/1995 | Frank et al. | 415/55.1 |
| 5,509,778 | A | 4/1996 | Hantle et al. | |
| 5,580,213 | A | 12/1996 | Woodward et al. | |
| 6,402,460 | B1 | 6/2002 | Fischer et al. | |
| 6,439,833 | B1 | 8/2002 | Pickelman et al. | |
| 6,454,520 | B1 | 9/2002 | Pickelman et al. | |
| 6,464,450 | B1 | 10/2002 | Fischer | |
| 6,527,506 | B2 * | 3/2003 | Pickelman et al. | 415/55.1 |
| 6,932,562 | B2 * | 8/2005 | Ross | 415/55.1 |
| 7,037,066 | B2 * | 5/2006 | Moss | 415/55.1 |
| RE39,891 | E | 10/2007 | Pickelman et al. | |

* cited by examiner

*Primary Examiner* — Edward Look
*Assistant Examiner* — Jason Davis
(74) *Attorney, Agent, or Firm* — Mark H. Svoboda

(57) ABSTRACT

An outlet plate of an impeller pump is provided, the outlet plate having an outlet port disposed in the outlet plate, the outlet port being defined by a first outlet port and a second outlet port each extending through the outlet plate; a separator wall located in the outlet port, the separator wall separating an inlet of the first outlet port from an inlet of the second outlet port; and a groove located only on a first surface of the outlet plate, the groove having a first distal end and a second distal end, the first distal end terminating at the first outlet port, wherein the separator separates the groove from the second outlet port.

17 Claims, 5 Drawing Sheets

FUEL PUMP WITH DUAL OUTLET PUMP

BACKGROUND

Exemplary embodiments of the present invention relate generally to regenerative turbine pumps of the type that are used to pump fuel from a fuel tank to an engine of a motor vehicle. More particularly, the invention pertains to an outlet port of a regenerative turbine fuel pump.

Automotive impeller style fuel pumps use a rotating impeller contained within a pump section pocket to pump fuel to the engine. Upper and lower plates are used to form the pocket and they are held within a very close proximity to the impeller surface to minimize fuel leakage from high to low pressure areas. Each plate contains a flow channel that function as parallel pumping chambers that are powered by the rotating impeller. The fluid enters the flow channels through an inlet port located at the beginning of the lower plate flow channel and a single outlet port is located at the end of the upper outlet plate flow channel to exhaust the flow. As the fluid exits the flow channel, the fluid in the lower flow channel flows through the rotating impeller and mixes with the fluid in the upper channel. This mixing creates turbulence and backflow that imparts drag on the impeller blades and reduces pump efficiency.

Accordingly, is desirable to provide a fuel pump design that addresses this turbulence and backflow created by the fluid mixing.

SUMMARY OF THE INVENTION

In one embodiment, an outlet plate of an impeller pump is provided, the outlet plate having an outlet port disposed in the outlet plate, the outlet port being defined by a first outlet port and a second outlet port each extending through the outlet plate; a separator wall located in the outlet port, the separator wall separating an inlet of the first outlet port from an inlet of the second outlet port; and a groove located only on a first surface of the outlet plate, the groove having a first distal end and a second distal end, the first distal end terminating at the first outlet port, wherein the separator separates the groove from the second outlet port.

In another embodiment an impeller pump is provided, the impeller pump having: an inlet plate, the inlet plate having an inlet port extending through the inlet plate and a first groove located only on a first surface of the inlet plate, the first groove having a first distal end and a second distal end, the first distal end terminating at the inlet port; an outlet plate, the outlet plate having an outlet port disposed in the outlet plate, the outlet port being defined by a first outlet port and a second outlet port each extending through the outlet plate; a separator wall located in the outlet port, the separator wall separating an inlet of the first outlet port from an inlet of the second outlet port; a second groove located only on a first surface of the outlet plate, the second groove having a first distal end and a second distal end, the first distal end terminating at the first outlet port, wherein the separator separates the second groove from the second outlet port; and an impeller rotatably secured between the inlet plate and the outlet plate, the impeller having a plurality of vanes aligned with the first groove and the second groove.

In still another embodiment, a method for separating fluid flow paths of an impeller pump is provided, the method comprising: drawing fluid into an inlet opening of the impeller pump by rotating an impeller, the impeller having a plurality of vanes; separating the fluid into a first fluid path and a second fluid path each being on opposite sides of the plurality of vanes of the impeller; and exhausting the fluid through an outlet of the impeller pump by rotating the impeller, the outlet being located on only one side of the impeller and having a first outlet port and a second outlet port each having an inlet being separated by a separator wall, wherein fluid in the first fluid path is exhausted through the first outlet port and fluid in the second fluid path is exhausted through the second outlet port.

DETAILED DESCRIPTION OF EXEMPLARY EMBODIMENTS

Reference is made to the following U.S. Pat. No. RE39,891; U.S. Pat. Nos. 6,464,450; 6,454,520; 6,439,833; 6,402,460; 5,580,213; 5,509,778; 5,393,206; 5,393,203; 5,280,213; 5,273,394; 5,209,630; 5,129,796; 5,013,222; and 4,734,008 the contents each of which are incorporated herein by reference thereto. The present disclosure relates to a regenerative turbine pump and more particularly, an outlet port design and method used in a regenerative turbine fuel pump.

As used in the fuel system of a motor vehicle, a regenerative turbine pump is intended to provide the engine of the vehicle with fuel at relatively high pressure at moderate flow rates.

Figure 1:
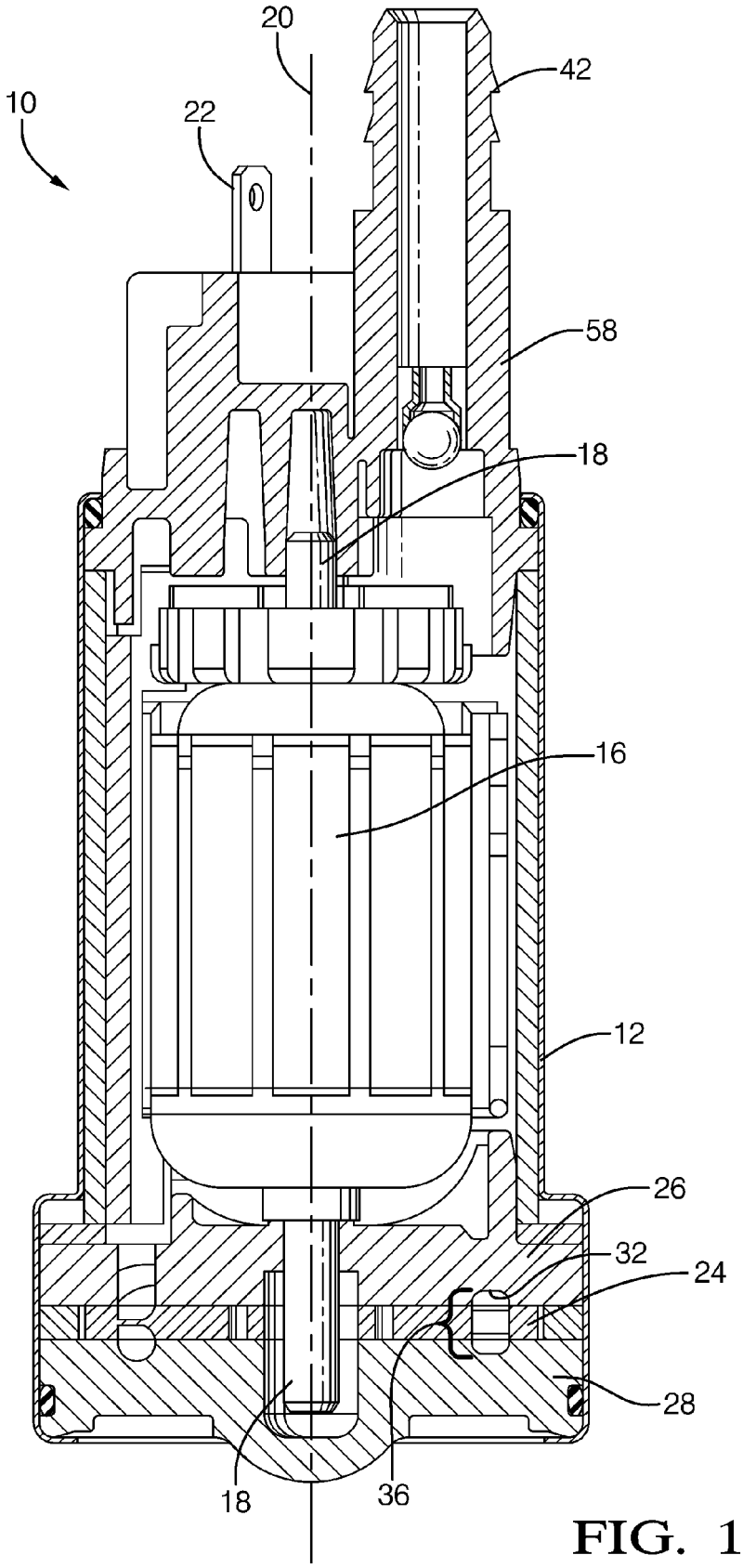
FIG. 1 is a cross-section view of a turbine pump.
Figure 2:
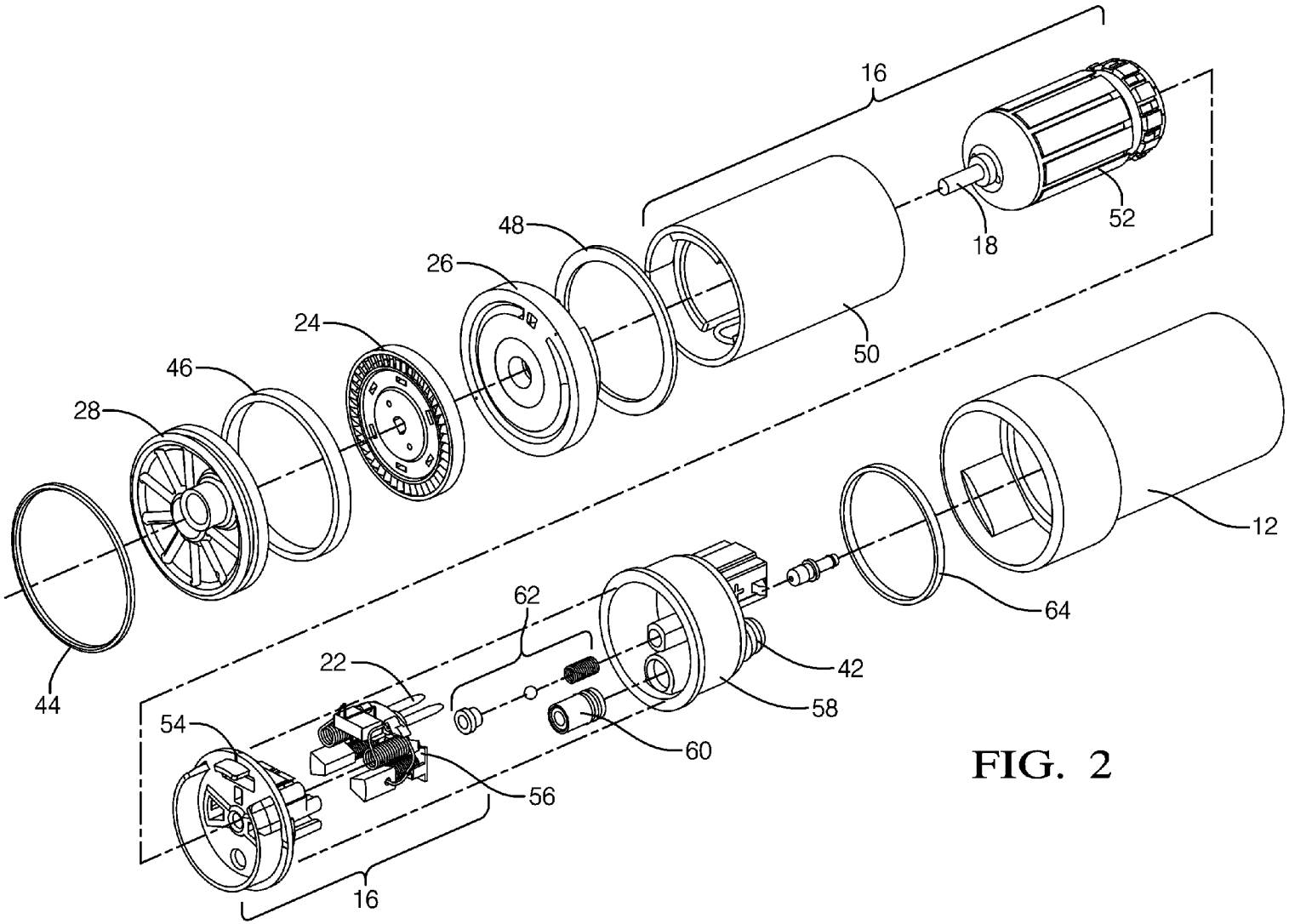
FIG. 2 is an exploded view of a turbine pump.
Figure 3:
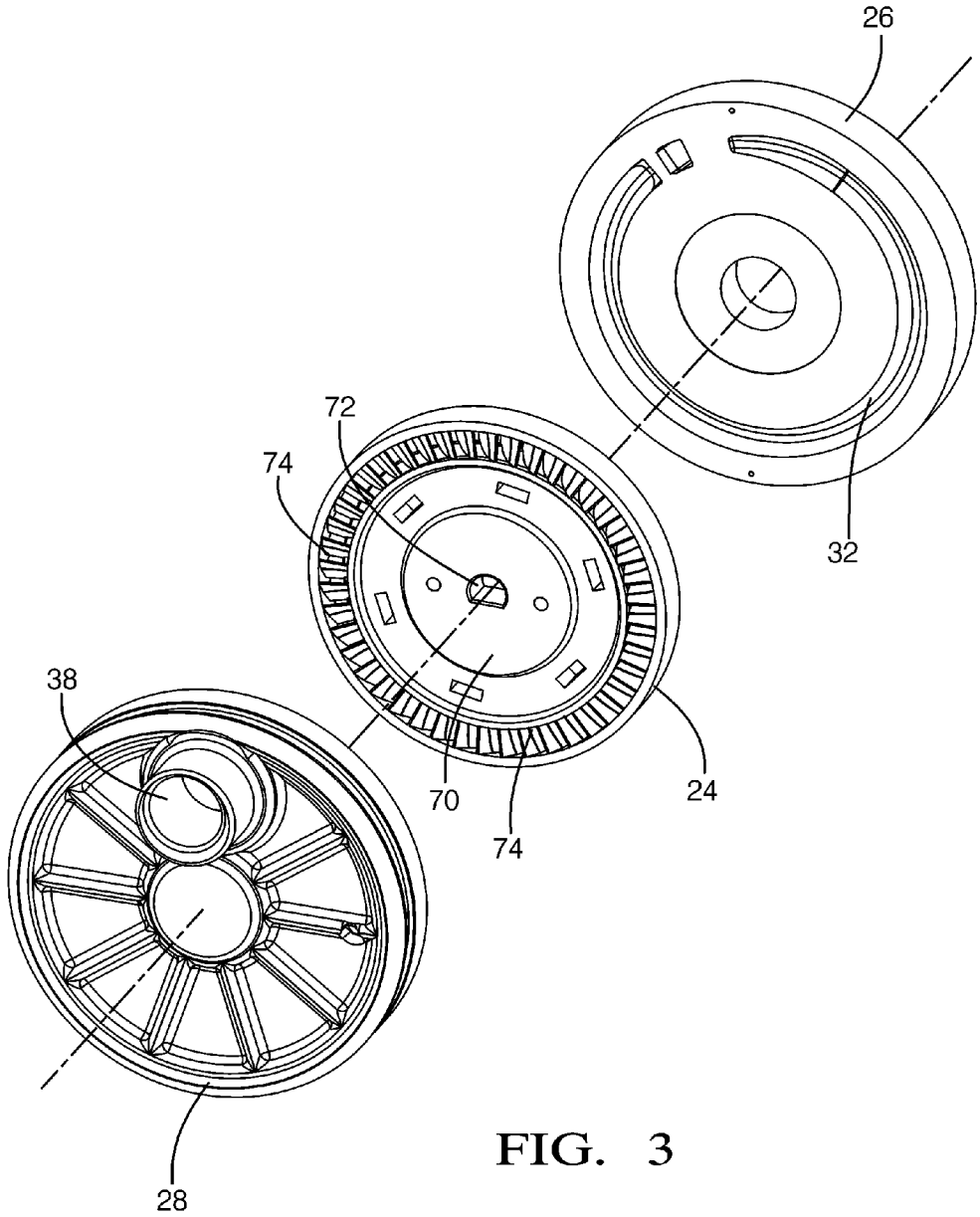
FIG. 3 is a perspective view of components of a turbine pump.

FIGS. 1 and 2 illustrates a regenerative turbine fuel pump 10, the pump has a shell or pump housing 12. Enclosed within this shell is an electric motor 16 that has an armature shaft 18, which is positioned within the housing so that the shaft can be rotated about a longitudinal center axis 20. Projecting from one end of the housing is a terminal 22. It is through this terminal via a wiring harness (not shown) on the vehicle that electrical energy can be supplied to the electric motor.

As illustrated in FIGS. 1 and 2, an impeller 24 is mounted to one end of the shaft. The impeller is situated between a pair of plates namely an upper or outlet plate 26 and a lower or inlet plate 28. Referring now to FIGS. 1-6 and between the plates there is defined a space 30 within which the impeller is designed to rotate. An annular groove 32 in the outlet plate cooperates with an annular groove 34 in the inlet plate to form an annular pump channel 36. The inlet plate also defines an inlet port 38 that communicates with annular groove 34. Similarly, the outlet plate has an outlet port 40 that communicates with annular groove 32.

In operation, the fuel tank of the vehicle communicates with the annular pump channel through the inlet port in inlet plate. This communication occurs through the annular groove on the inlet plate, as well as through known passageway(s) internal to fuel pump 10. The pump includes an end cap 58 which defines a discharge tube or discharge port 42 to which the outlet port is connected via other known passageway(s)

within the fuel pump. Through outlet port 40, discharge port 42 communicates with the annular pump channel on the outlet side of the impeller, i.e., through annular groove 32. It is from this discharge tube 42 that pressurized fuel is discharged from and delivered by the fuel pump 10 for use by the engine of the vehicle.

FIG. 2 illustrates additional components of the fuel pump such as an O-ring 44, a spacer 46, a load ring 48, components of motor 16 such as a magnet assembly 50, an armature 52, a brush carrier 54, and a RFI module 56. In addition, a check valve 60, a relief valve 62 and a gasket 64 are also illustrated.

The impeller serves as the rotary pumping element for the regenerative turbine pump 10. As shown in the FIGS., the impeller basically takes the form of a disk having a hub 70 whose axis of rotation is centered on center axis 20. The hub 70 defines an aperture 72 at its center. The aperture 72 is notched or appropriately configured, to accommodate the like-shaped shaft of the motor. The notched aperture allows the shaft to drive the impeller when the electrical motor is activated.

Figure 4:
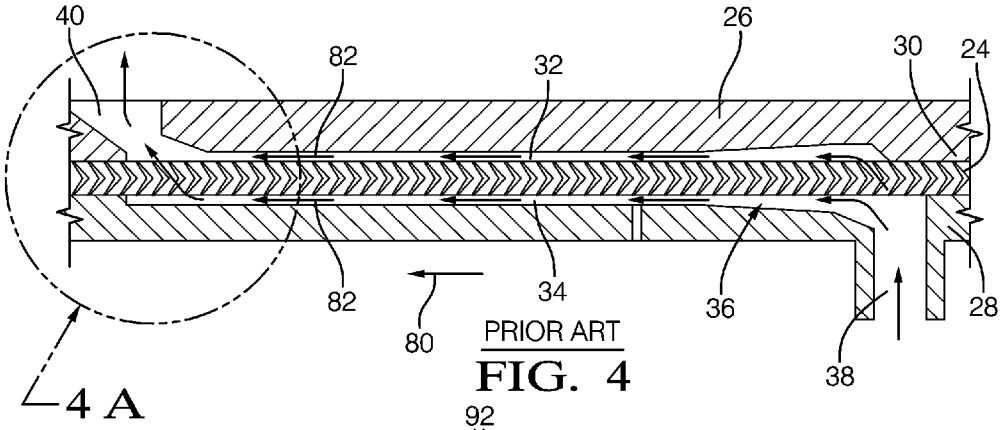
PRIOR ART FIG. 4
FIGS. 4 and 4A are cross-sectional views of a portion of a turbine pump.
Figure 5:
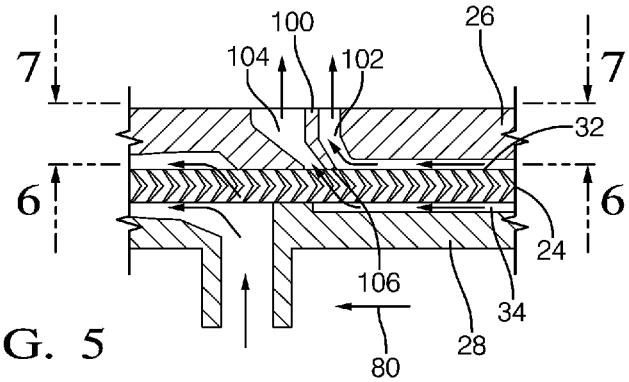
FIG. 5 is a cross-sectional view of portions of a turbine pump constructed in accordance with an exemplary embodiment of the present invention.

The impeller has a plurality of fan blades 74 that project radially outward from the hub. Also referred to as vanes, the fan blades are generally spaced from each other uniformly. As best shown in FIGS. 4-5, each of the vanes is V-shaped. Radiating from the periphery of the hub the vanes are situated in between and adjacent to the annular grooves 32 and 34 in the inlet and outlet plates, respectively. In other words, the vanes are positioned directly within the annular pump channel of the regenerative turbine pump.

The regenerative turbine fuel pump 10 operates as follows. When electricity is supplied via terminal 22 to the electric motor 16, the armature shaft 18 immediately begins to rotate. The rotation of the shaft, in turn, causes the impeller to rotate within an appropriately shaped space between the inner and outer plates. Fuel from the fuel tank is sucked into the inlet port and flows into the annular groove 34 and thus into the annular pump channel 36.

The rotation of the impeller imparts both a centrifugal and a tangential force on the fuel. As the impeller rotates in the direction of arrow 80, its V-shaped vanes, in combination with annular grooves 32 and 34 on either side, cause the fuel to whirl about the annular pump channel 36 in a toroidal flow path, as is best shown in FIGS. 4-5. More specifically, the centrifugal force moves the fuel with velocity in the radial direction with respect to the hub.

The combined geometry of the annular pump channel 36 and the vanes of the impeller ultimately cause the fuel to flow within, and in a direction that is tangential to, the annular pump channel. The collective action of the blades thus imparts a tangential velocity to the fuel illustrated by arrows 82. In one configuration, the flow channels each have an arcuate configuration and each of the vanes of the impeller have an upper portion and a lower portion each being angularly configured with respect to each other and a plane of rotation of the impeller.

Figure 4A:
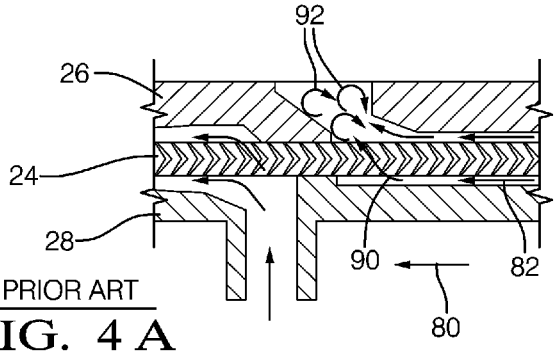
PRIOR ART FIG. 4 A

In accordance with an exemplary embodiment of the present invention a means to separate the upper and lower channel exhaust flow is provided. Thus, reducing the turbulent back flow and increasing pump efficiency. For example and as shown in FIGS. 4 and 4A as the flow of fuel in the groove 34 approaches the distal end of groove 34 is it pushed upwardly in the direction of arrows 90 wherein the fluid or fuel travelling in the lower channel collides or mixes with the fuel in the upper channel and creates turbulence and backflow that imparts drag on the impeller blades and reduces pump efficiency. This turbulence is illustrated by arrows 92 in FIG. 4A.

Figure 6:
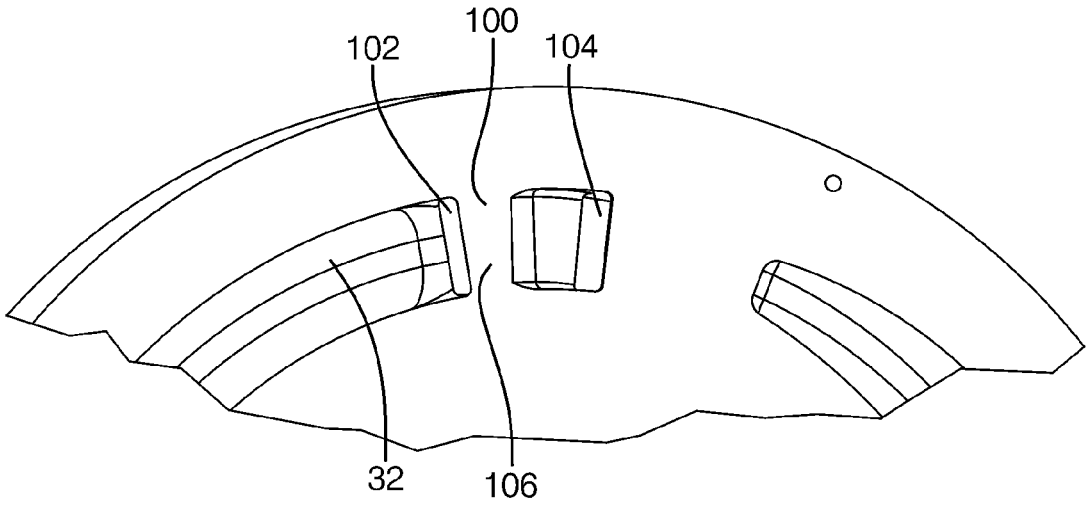
FIG. 6 is a view along lines 6-6 of FIG. 5.
Figure 7:
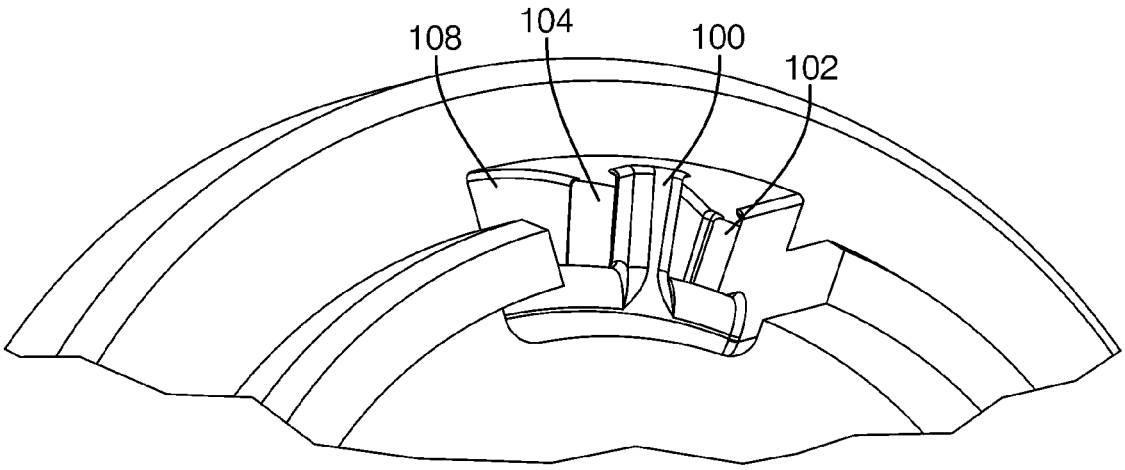
FIG. 7 is a view along lines 7-7 of FIG. 5.

Accordingly and in order to prevent this turbulence and in accordance with an exemplary embodiment of the present invention and referring now to FIGS. 5-7, a separator 100 is located in the outlet port. The separator divides the outlet port into two individual ports a first outlet port or opening 102 and a second outlet port or opening 104. As illustrated, a face 106 of the separator is in very close proximity to the impeller at a distance roughly equal to the axial clearance between the impeller and the plates while still allowing for rotational movement of the impeller. The face of the separator functions to strip fuel traveling in the upper flow channel or groove 32 from the impeller and direct it into the upstream or first outlet port. The first port 102 and channel geometry 32 is designed to create minimal disruption to the lower channel flow as the upper channel flow enters its respective outlet port. Ideally the fluid velocity remains relatively unchanged as it transitions from the flow channel into the outlet port. This is accomplished by designing the cross sectional flow area of the entrance of the outlet port 102 to approximately equal to the cross sectional area of the flow channel 32. Also, the angle of inclination and curvature of the leading wall of the separator 100 is designed to minimize energy losses and efficiently direct the fluid flow from the flow stream into the outlet port while maintaining manufacturability. Furthermore, the outlet sides of ports 102 and 104 are configured to provide for exhausting of the fluid flow.

As illustrated, the lower flow channel 34 terminates in close axial proximity to the terminating edge of the downstream outlet port or second outlet port 104. The fluid traveling in the lower flow channel 34 is forced by the channel termination upward into the downstream outlet port or second outlet port. Since the upper channel flow has already exited there is minimal mixing and back flow imparted on the impeller blades. This increases the pump efficiency as compared to conventional single outlet port designs (illustrated in FIG. 4). The port geometry and angle of inclination/curvature discussed for the upstream outlet port or first outlet port also applies to the downstream outlet port or second outlet port.

In accordance with exemplary embodiment of the present invention, the angle and/or curvature of the separator can be adjusted to efficiently collect the fluid flow and change the flow to the desired direction. The cross sectional flow area of the upstream and down stream ports can be adjusted to produce a fluid velocity that allows for efficient exhausting of flow for example, the geometry of the inlet and outlet of each port may vary accordingly.

The down stream exit port geometry can also be changed or configured to allow for additional time for the inlet channel flow to travel through the blades and reach the port. See for example, the larger opening 108 of the exit port geometry of the downstream or second outlet port.

The down stream edge of the separator can also be altered or configured to close off the blade inlet area (hub half of the blade) to prevent centrifugal force to draw fluid from the upper plate side back into the blade (See FIG. 5). By extending the down stream edge to cover the blade inlet the centrifugal force will draw fluid from the lower flow channel, aiding the transfer of fluid from the lower plate to the downstream outlet port.

The width of the separator can also be changed to control the timing at which the lower channel flow begins to cross through the impeller relative to the upstream port.

In addition and as an alternative embodiment, multiple ports can be added side by side as well angularly offset from each other.

Figure 5A:
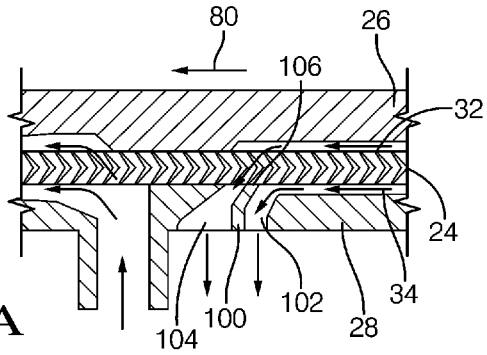
FIG. 5A is a cross-sectional view of portions of a turbine pump constructed in accordance with an alternative exemplary embodiment of the present invention.

Referring now to FIG. 5A another alternative exemplary embodiment is illustrated, here the outlet port and the inlet port are located in the same plate namely plate 28, which in this embodiment will be referred to as the outlet plate since plate 28 now includes the outlet port and the inlet port. In this embodiment flow channels 32 and 34 are disposed in plates 28 and 26 respectively, to define pump channel 36 however plate 26 only has flow channel 34 disposed therein. Furthermore, the location of discharge tube 42 may be relocated to coincide with location of the outlet port.

Similar to the previous embodiments, a separator 100 is located in the outlet port, wherein the separator divides the outlet port into two individual ports a first outlet port or opening 102 and a second outlet port or opening 104. As illustrated, a face 106 of the separator is in very close proximity to the impeller at a distance roughly equal to the axial clearance between the impeller and the plates while still allowing for rotational movement of the impeller. The face of the separator functions to strip fuel traveling in the lower flow channel or groove 34 and direct it into the first outlet port 102. The first outlet port 102 and channel geometry 34 is designed to create minimal disruption to the upper channel flow as the upper channel flow enters its respective outlet port (e.g., port 104). Ideally the fluid velocity remains relatively unchanged as it transitions from the flow channel into the outlet port. This is accomplished by designing the cross sectional flow area of the entrance of the outlet port 102 to approximately equal to the cross sectional area of the flow channel 34. Also, the angle of inclination and curvature of the leading wall of the separator 100 is designed to minimize energy losses and efficiently direct the fluid flow from the flow stream into the outlet port while maintaining manufacturability. Furthermore, the outlet sides of ports 102 and 104 are configured to provide for exhausting of the fluid flow by for example having larger outlet sides versus inlet sides.

As illustrated, the lower flow channel 34 terminates in close axial proximity to the first outlet port 102 and the fluid traveling in the lower flow channel 34 is forced by the channel termination into outlet port 102.

While the invention has been described with reference to exemplary embodiments, it will be understood by those skilled in the art that various changes may be made and equivalent elements may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another. Further, the use of the terms a, an, etc. do not denote a limitation of quantity, but rather denote the presence of at least one of the referenced item.

What is claimed is:

1. An outlet plate of an impeller pump, the outlet plate comprising:

an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port; and a groove located only on a first surface of the outlet plate, the groove having a first distal end and a second distal end, the first distal end terminating at the first outlet port, wherein the separator wall separates the groove from the second outlet port, wherein a portion of the separator wall and the first outlet port is are angled towards the groove.

2. The outlet plate as in claim 1, wherein the groove has an arcuate configuration.

3. The outlet plate as in claim 1, wherein the outlet port is located inboard from a periphery of the outlet plate and the groove is also located inboard from the periphery of the outlet plate and wherein the outlet plate further comprises an inlet port disposed in the outlet plate, the inlet portion being in fluid communication with the groove proximate to the second distal end.

4. An outlet plate of an impeller pump, the outlet plate comprising:

an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port; and a groove located only on a first surface of the outlet plate, the groove having a first distal end and a second distal end, the first distal end terminating at the first outlet port, wherein the separator wall separates the groove from the second outlet port, wherein the outlet plate has a second surface opposite the first surface and the separator wall does not extend to the second surface.

5. An impeller pump, the impeller pump comprising:

an inlet plate, the inlet plate having an inlet port extending through the inlet plate and a first groove located only on a first surface of the inlet plate, the first groove having a first distal end and a second distal end, the first distal end terminating at the inlet port;

an outlet plate, the outlet plate having an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port;

a second groove located only on a first surface of the outlet plate, the second groove having a first distal end and a second distal end, the first distal end terminating at the first outlet port, wherein the separator wall separates the second groove from the second outlet port; and an impeller rotatably secured between the inlet plate and the outlet plate, the impeller having a plurality of vanes aligned with the first groove and the second groove;

wherein the inlet of the first outlet port and the inlet of the second outlet port are both adjacent to the plurality of vanes of the impeller.

6. An impeller pump, the impeller pump comprising:

an inlet plate, the inlet plate having an inlet port extending through the inlet plate and a first groove located only on a first surface of the inlet plate, the first groove having a first distal end and a second distal end, the first distal end terminating at the inlet port;

an outlet plate, the outlet plate having an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port;

a second groove located only on a first surface of the outlet plate, the second groove having a first distal end and a second distal end, the first distal end terminating at the first outlet port, wherein the separator wall separates the second groove from the second outlet port; and an impeller rotatably secured between the inlet plate and the outlet plate, the impeller having a plurality of vanes aligned with the first groove and the second groove, wherein a portion of the separator wall and the first outlet port are angled towards the second groove.

7. The impeller pump as in claim 6, wherein the first groove and the second groove each have an arcuate configuration and wherein each of the vanes of the impeller have an upper portion and a lower portion each being angularly configured with respect to each other and a plane of rotation of the impeller.

8. The impeller pump as in claim 6, wherein the outlet port is located inboard from a periphery of the outlet plate and the second groove is also located inboard from the periphery of the outlet plate.

9. An impeller pump, the impeller pump comprising:

an inlet plate, the inlet plate having an inlet port extending through the inlet plate and a first groove located only on a first surface of the inlet plate, the first groove having a first distal end and a second distal end, the first distal end terminating at the inlet port;

an outlet plate, the outlet plate having an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port;

a second groove located only on a first surface of the outlet plate, the second groove having a first distal end and a second distal end, the first distal end terminating at the first outlet port, wherein the separator wall separates the second groove from the second outlet port; and an impeller rotatably secured between the inlet plate and the outlet plate, the impeller having a plurality of vanes aligned with the first groove and the second groove, wherein the outlet plate has a second surface opposite the first surface and the separator wall does not extend to the second surface.

10. An impeller pump, the impeller pump comprising:

an inlet plate, the inlet plate having an inlet port extending through the inlet plate and a first groove located only on a first surface of the inlet plate, the first groove having a first distal end and a second distal end, the first distal end terminating at the inlet port;

an outlet plate, the outlet plate having an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port;

a second groove located only on a first surface of the outlet plate, the second groove having a first distal end and a second distal end, the first distal end terminating at the first outlet port, wherein the separator wall separates the second groove from the second outlet port; and an impeller rotatably secured between the inlet plate and the outlet plate, the impeller having a plurality of vanes aligned with the first groove and the second groove, wherein the first groove begins at the inlet port and terminates at a position axially aligned with the second outlet port.

11. The impeller pump as in claim 10, wherein portions of the first groove are parallel with portions of the second groove and wherein the second groove terminates before the first groove.

12. An impeller pump, the impeller pump comprising:

an inlet plate, the inlet plate having an inlet port extending through the inlet plate and a first groove located only on a first surface of the inlet plate, the first groove having a first distal end and a second distal end, the first distal end terminating at the inlet port;

an outlet plate, the outlet plate having an outlet port disposed in the outlet plate, the outlet port being defined by a first outlet port and a second outlet port each extending through the outlet plate;

a separator wall located in the outlet port, the separator wall separating an inlet of the first outlet port from an inlet of the second outlet port;

a second groove located only on a first surface of the outlet plate, the second groove having a first distal end and a second distal end, the first distal end terminating at the first outlet port, wherein the separator wall separates the second groove from the second outlet port; and an impeller rotatably secured between the inlet plate and the outlet plate, the impeller having a plurality of vanes aligned with the first groove and the second groove, wherein a face of the separator wall periodically aligns with a corresponding face of each vane of the impeller as the impeller rotates between the outlet plate and the inlet plate.

13. A method for separating fluid flow paths of an impeller pump, the method comprising:

drawing fluid into an inlet opening of the impeller pump by rotating an impeller, the impeller having a plurality of vanes;

separating the fluid into a first fluid path and a second fluid path each being on opposite sides of the plurality of vanes of the impeller; and exhausting the fluid through an outlet of the impeller pump by rotating the impeller, the outlet being located on only one side of the impeller and having a first outlet port and a second outlet port each having an inlet being separated by a separator wall, wherein fluid in the first fluid path is exhausted through the first outlet port and fluid in the second fluid path is exhausted through the plurality of vanes of the impeller and through the second outlet port.

14. A method for separating fluid flow paths of an impeller pump, the method comprising:

drawing fluid into an inlet opening of the impeller pump by rotating an impeller, the impeller having a plurality of vanes;

separating the fluid into a first fluid path and a second fluid path each being on opposite sides of the plurality of vanes of the impeller; and exhausting the fluid through an outlet of the impeller pump by rotating the impeller, the outlet being located on only one side of the impeller and having a first outlet port and a second outlet port each having an inlet being separated by a separator wall, wherein fluid in the first fluid path is exhausted through the first outlet port and fluid in the second fluid path is exhausted through the second outlet port, wherein the first fluid path is located in an outlet plate disposed on one side of the impeller and the second fluid path is located in an inlet plate located on another side of the impeller and wherein the outlet is located in the outlet plate and a portion of the separator wall and the first outlet port are angled towards the first fluid path.

15. The method as in claim 14, wherein the first fluid path and the second fluid path each have an arcuate configuration and wherein each of the vanes of the impeller have an upper portion and a lower portion each being angularly configured with respect to each other and a plane of rotation of the impeller.

16. The method as in claim 14, wherein the second fluid path begins at an inlet port in the inlet plate and the second fluid path terminates at a position axially aligned with the second outlet port.

17. The method as in claim 16, wherein portions of the first fluid path are parallel with portions of the second fluid path and wherein the first fluid path terminates before the second fluid path.

* * * * *